US011761692B2

(12) United States Patent
Bouquet

(10) Patent No.: US 11,761,692 B2
(45) Date of Patent: Sep. 19, 2023

(54) REFRIGERATION SYSTEM AND METHOD OF OPERATING A REFRIGERATION SYSTEM

(71) Applicant: UTC Fire & Security EMEA BVBA, Diegem (BE)

(72) Inventor: Xavier-Pierre Nicolas Bouquet, Montluel (FR)

(73) Assignee: UTC FIRE & SECURITY EMEA BVBA, Diegem (BE)

( * ) Notice: Subject to any disclaimer, the term of this patent is extended or adjusted under 35 U.S.C. 154(b) by 230 days.

(21) Appl. No.: 17/132,761

(22) Filed: Dec. 23, 2020

(65) Prior Publication Data

US 2022/0154983 A1 May 19, 2022

(30) Foreign Application Priority Data

Nov. 16, 2020 (EP) ..... 20207894

(51) Int. Cl.
*F25B 39/02* (2006.01)

(52) U.S. Cl.
CPC ..... *F25B 39/02* (2013.01)

(58) Field of Classification Search
CPC ..... F25B 41/26; F25B 39/028; F25B 39/02; F25B 2700/135; F25B 13/00; F28D 7/1607; F28D 2021/0071; F28D 2021/007; F28F 27/02; F28F 9/0202; F28F 2265/12
See application file for complete search history.

(56) References Cited

U.S. PATENT DOCUMENTS

| | | | | |
|---|---|---|---|---|
| 2,649,698 | A | 8/1953 | Goldmann | |
| 3,990,504 | A | 11/1976 | Kolthoff, Jr. | |
| 2014/0083117 | A1* | 3/2014 | Rusich | F25B 39/028 251/310 |
| 2016/0054077 | A1* | 2/2016 | Saito | F28F 9/0209 165/173 |

FOREIGN PATENT DOCUMENTS

| | | | | |
|---|---|---|---|---|
| EP | 2309219 | A1 * | 4/2011 | F24D 3/087 |
| EP | 2309219 | A1 | 4/2011 | |

OTHER PUBLICATIONS

Pdf is translation of foreign referecne EP-2309219-A1 (Year: 2011).*
Pdf is translation of foreign reference EP-2309219-A1 (Year: 2011).*
European Search Report; Application No. 20207894.5-1002; dated Apr. 29, 2021; 8 pages.

* cited by examiner

*Primary Examiner* — Len Tran
*Assistant Examiner* — Kamran Tavakoldavani
(74) *Attorney, Agent, or Firm* — CANTOR COLBURN LLP

(57) ABSTRACT

A refrigeration system comprising an evaporator, and a method of operating a refrigeration system. The evaporator comprises: a first fluid volume upstream of a second fluid volume, and a plurality of channels fluidly connecting the first fluid volume and the second fluid volume. The system further comprises a flow restrictor arranged to prevent fluid flow through at least a first channel of the plurality of channels in response to a pressure difference between the first fluid volume and the second fluid volume being less than a predetermined threshold, and to permit fluid flow through the first channel in response to the pressure difference being greater than the predetermined threshold.

14 Claims, 4 Drawing Sheets

REFRIGERATION SYSTEM AND METHOD OF OPERATING A REFRIGERATION SYSTEM

CROSS-REFERENCE TO RELATED APPLICATIONS

This application claims the benefit of European Application No. 20207894.5 filed Nov. 16, 2020, the disclosure of which is incorporated herein by reference in its entirety.

FIELD

The present invention relates to a refrigeration system comprising an evaporator, and to a method of operating a refrigeration system.

BACKGROUND

Refrigeration systems are used for a wide variety of heating requirements, chilling requirements and environmental conditioning, including comfort and industrial applications. Different systems may be adapted for different purposes, with components of the system being designed to provide a desired or predetermined function and operate within a particular range of parameters or serve a particular regime e.g. a particular range of temperatures. For example, a refrigeration system for making ice may not be suitable for air conditioning a space, and so on.

Some systems use liquid coolant and operate in negative temperature brine conditions e.g. by using a working fluid (e.g. water) that contains an additive, which additive allows the working fluid to operate below its freezing temperature without freezing (the temperature is then negative with respect to the Celsius (° C.) temperature scale). Refrigeration systems operating in negative temperature brine conditions typically use a suitable heat exchanger, such as a brazed plate heat exchanger (BPHE), or a direct expansion (DX) evaporator. However, they may instead use evaporators (e.g. a flooded evaporator) having a bundle of heat exchange tubes of a predetermined cross-section in order to promote the desired fluid velocity required to maintain sufficient turbulence for desired heat transfer. However, the use of a bundle of tubes of a predetermined size limits the functionality of the refrigeration system, since the higher flow required for e.g. positive temperature brine conditions is not possible without creating too large a pressure drop through the evaporator.

SUMMARY

According to first aspect of the present invention there is provided a refrigeration system comprising an evaporator, the evaporator comprising: a first fluid volume upstream of a second fluid volume, and a plurality of channels fluidly connecting the first fluid volume and the second fluid volume; the system further comprising a flow restrictor arranged to prevent fluid flow through at least a first channel of the plurality of channels in response to a pressure difference between the first fluid volume and the second fluid volume being less than a predetermined threshold, and to permit fluid flow through the first channel in response to the pressure difference being greater than the predetermined threshold.

The refrigeration system may therefore operate in two distinct modes, one having a lower total flow cross-section through the evaporator, and the other having a higher total flow cross-section through the evaporator.

The flow restrictor may be arranged to move or transition between a first configuration in which the first channel is closed and a second configuration in which the first channel is open. The flow restrictor may therefore be operable to control flow between the first and second fluid volumes by closing and/or opening the first channel. The flow restrictor may therefore be operable to increase fluid velocity in the channels that remain open in order to maintain sufficient turbulence for desired heat transfer e.g. when fluid viscosity increases due to lower brine temperature conditions. The flow restrictor may be arranged to reduce the total cross-section of flow through the evaporator in the first mode, and increase the total cross-section of flow through the evaporator in the second mode. The flow restrictor may be arranged to ensure that the flow cross-section out of the first fluid volume is the same as the flow cross-section in to the second fluid volume (e.g. in a multi-pass evaporator). The flow restrictor may be arranged to maintain fluid velocity in the plurality of channels within a predetermined range. The flow restrictor may be arranged to reduce the total-flow cross section in response to the total flow volume through the evaporator being less than a total fluid flow volume threshold and thereby maintain fluid velocity in the plurality of channels above a fluid velocity threshold. The flow restrictor may be arranged to increase the total-flow cross section in response to the total flow volume through the evaporator being more than the total fluid flow volume threshold and thereby maintain fluid velocity in the plurality of channels above the fluid velocity threshold while maintaining the pressure difference below a desired or predetermined level. The pressure difference may be a function of the flow rate of fluid, and of the temperature, and of other system conditions and parameters. Therefore the fluid flow volume threshold may vary as a function of the temperature etc. The predetermined threshold of the pressure difference may be a function of system conditions. The pressure difference may be a function of flow rate. The thresholds discussed herein may be for given (e.g. fixed) system conditions (e.g. for given temperature, glycol percentage, and so on). The thresholds may be different for different system conditions or applications.

The system may be operable in two different modes, for example a first, negative brine temperature, low-flow mode in which flow through the first channel is prevented, and a second, positive brine temperature, high-flow mode in which flow through the first channel is permitted. The invention may therefore provide a refrigeration system capable of dual modes e.g. for negative and positive temperature chilled water. The flow restrictor may automatically adjust the flow through the evaporator in response to changes in the pressure difference between the first and second fluid volumes (e.g. the pressure drop across the evaporator). Such changes may be caused by e.g. a user changing a desired setting e.g. increasing a pump speed for positive temperature by delivering more cooling capacity, or a decrease of temperature (therefore increasing viscosity of the working fluid, subsequently increasing a pressure drop for a given flow rate). The change in pressure difference may be caused by any suitable system or environmental changes.

The flow restrictor may be arranged to prevent or permit fluid flow through multiple of the plurality of channels. Typically, the evaporator will have a bundle of tubes providing the plurality of channels between the first and second fluid volumes, and the flow restrictor may be arranged to prevent or permit fluid flow through multiple of the plurality of channels (i.e. not only through the first fluid channel). The flow restrictor may be arranged to prevent or permit fluid flow through multiple—but not all—of the plurality of channels. The flow restrictor may be arranged to only prevent fluid flow through some (e.g. a subset) of the plurality of channels. The flow restrictor may not be capable of preventing fluid flow through all of the fluid channels. The flow restrictor may be arranged not to prevent or permit fluid flow through some of the plurality of channels. The flow restrictor may therefore be arranged to prevent or permit fluid flow through the first channel (or through multiple of the plurality of channels) and to always permit fluid flow through others of the plurality of channels. There may be some flow through the evaporator in both modes e.g. there may always be flow through the evaporator during use.

The flow restrictor may be arranged to control (i.e. prevent or permit) fluid flow through about a quarter of the plurality of channels, or about a third of the plurality of channels, or about half of the plurality of channels, or about three quarters of the plurality of channels. The flow restrictor may therefore have a substantial effect on the flow through the evaporator. The flow restrictor may be arranged to control flow through more than a quarter of the plurality of channels, more than half, or more than three quarters.

The plurality of channels may be heat exchange channels (e.g. tubes), and may therefore be arranged to permit heat exchange between fluid flowing therein (e.g. from the first fluid volume to the second fluid volume) and another fluid outside the channels. The flow restrictor may therefore be arranged to increase or decrease heat exchange by increasing or decreasing fluid flow between the first fluid volume and the second fluid volume as needed. The system may be arranged so that the first and second fluid volumes receive coolant fluid (e.g. water and an antifreeze additive, brine, etc.) during use. The system may be arranged so that in use refrigerant is outside the first and second fluid volumes, and outside the plurality of channels. The system may be arranged so that during use, the coolant fluid exchanges heat with refrigerant. The system may comprise a liquid coolant cycle and the first and second fluid volumes and the plurality of channels may form part of the liquid coolant cycle. The evaporator and flow restrictor may be part of the liquid coolant cycle. The system may be arranged so that fluid in the liquid coolant cycle is always liquid during use. The system may be arranged so that during use the refrigerant undergoes a vapour compression cycle and changes its state to and from liquid e.g. inside the evaporator. The system may be arranged so that the coolant fluid in the cycle through the evaporator always remains liquid during use (e.g. a water or aqueous mixture). That is, the system may be arranged so that the working fluid (e.g. coolant fluid) in the first and second fluid volumes of the evaporator may always be liquid during use and throughout its cycle. The invention may therefore relate to systems relying on liquid coolant (and not to direct expansion systems using only e.g. refrigerant fluids and air).

The second fluid volume may be downstream of the first fluid volume and therefore may be arranged to receive fluid flow from the first fluid volume. All fluid flow from the first fluid volume to the second fluid volume may be via the plurality of channels. The first channel may carry only a portion of the fluid flow between the first fluid volume and the second fluid volume. Where the flow restrictor controls flow through multiple of the plurality of fluid channels, the multiple channels may carry only a portion of the flow between the first fluid volume and the second fluid volume (when they are open).

The evaporator may be any suitable evaporator. The evaporator may be a flooded evaporator. The evaporator may be any suitable wet evaporator. The evaporator may be a falling-film evaporator, or the like. The evaporator may be any shell-and-tube type heat exchanger that uses coolant (e.g. water or any other coolant fluid) inside the tubes, and refrigerant outside the tubes in the shell. The system may be arranged so that the evaporator receives 100% liquid coolant in the first and second fluid volumes, and so that the coolant remains liquid throughout the cycle comprising the first and second fluid volumes. The evaporator may be a liquid chiller, or may be a heat pump using liquid coolant as a heat source.

The refrigeration system may be any suitable heat cycle system, e.g. a refrigeration system, a heat pump, and so on. The refrigeration system may be a liquid chilling system. The refrigeration system may be any system relying on liquid coolant. The refrigeration system may not use only refrigerant fluids and air. The refrigeration system may be operable to heat and/or cool e.g. depending on the mode of operation. For example, the system may be arranged to chill when the flow restrictor is in the first configuration, and may be operable to chill less (or heat) when the flow restrictor is in the second configuration. The system may be a heating, ventilation, and air conditioning (HVAC) system. The system may be a heating, ventilation, air conditioning and refrigeration (HVACR) system. The system may be a heating, air conditioning and refrigeration (HACR) system. The refrigeration system may be a heating and refrigeration system.

The evaporator may be a single-pass evaporator e.g. so that the first fluid volume and second fluid volume are at opposite ends of evaporator. Alternatively, the evaporator may be a multi-pass evaporator. The evaporator may be two-pass evaporator e.g. so that the first fluid volume and second fluid volume are on the same side of the evaporator.

The flow restrictor may be part of the evaporator, or may be part of the refrigeration system. The flow restrictor may be mechanically coupled to the evaporator. The flow restrictor may not control fluid flow outside the evaporator.

The first and second fluid volumes may be mutually exclusive of each other e.g. they may not overlap each other. The first and second fluid volumes may be entirely within the evaporator. All fluid entering the second fluid volume may come from the first fluid volume (e.g. via the plurality of channels).

The flow restrictor may be an electronic device. It may comprise e.g. one or more pressure sensors arranged to detect pressure in the first fluid volume and second fluid volume, and may be configured to switch the flow restrictor between modes in response measurements from the sensor (s). The electronic flow restrictor may comprise an electronically powered actuator or the like. The electronic flow restrictor may be operable to control fluid flow through the at least first fluid channel on command e.g. by a user of the refrigeration system. The flow restrictor may be operable by an electronic controller or command circuit e.g. a system controller or the like, which system controller may also be arranged to control other components of the refrigeration system. The electronic flow restrictor may change configurations in response to a command (e.g. a signal) from the controller. The electronic flow restrictor may be located (at least partially) outside the evaporator. The flow restrictor may be operable to control flow through the first fluid channel to benefit from more heat transfer surface e.g. if the system is working at compatible conditions regarding turbulence.

The flow restrictor may be mechanical. The flow restrictor may be fully mechanical, and may be operable in response to the pressure difference between the first fluid volume and the second fluid volume. The flow restrictor may be pressure-actuated, and may change configurations in response to a change in the pressure difference. It is therefore possible to avoid e.g. an externally powered actuator and/or an electronic controller or command circuit for controlling the flow restrictor.

The flow restrictor may therefore automatically regulate the total flow cross-section through the evaporator, and hence may automatically regulate the fluid flow velocity in the plurality of channels. Thus, the flow restrictor may automatically regulate turbulence in the plurality of channels, and may therefore automatically regulate heat exchange efficiency. The flow restrictor may therefore be operable only in response to the pressure difference and may not e.g. be controllable by any other means. Alternatively, the flow restrictor may comprise a manual override, for permitting or preventing fluid flow through the first fluid channel regardless of the pressure difference.

The flow restrictor may comprise a piston moveable between a first position and a second position, and may comprise a biasing mechanism arranged to urge the piston to the first position. The flow restrictor may be arranged so that the piston is urged by the biasing mechanism to the first position when the pressure difference between the first fluid volume and the second fluid volume is less than the predetermined threshold, and so that the piston is moved to the second position against the action of the biasing mechanism when the pressure difference is greater than the predetermined threshold. The biasing mechanism may therefore determine the predetermined threshold at which the flow restrictor changes between its first and second configurations. The biasing mechanism may therefore be selected so that the flow restrictor changes configuration (and therefore changes operation modes) at the predetermined threshold.

The biasing mechanism may be any suitable mechanical device, and may be e.g. a spring, a coil spring, a leaf spring, a resilient member, a predetermined weight, and so on.

The flow restrictor may comprise an actuable flap arranged to permit or prevent fluid flow through the first channel. The actuable flap may be actuable by movement of the piston, which piston may be actuable by the pressure difference between the first fluid volume and the second fluid volume.

For example, when the pressure difference increases beyond the predetermined threshold (e.g. as the refrigeration system transitions to a higher total flow mode such as a positive brine temperature, high-flow operation), the pressure difference (i.e. the pressure drop through the evaporator) may increase because of the higher flow, and may thereby cause the piston to move against the action of the biasing mechanism from its first position to its second position. The movement of the piston may cause (e.g. by a mechanical coupling) the actuable flap to move (e.g. to open) and thereby permit fluid flow through the first channel.

When the pressure difference decreases to less than the predetermined threshold (e.g. as the system transitions to a lower total flow mode such as a negative brine temperature, low-flow operation), the biasing mechanism may overcome the force arising from the pressure difference and cause the piston to move from its second position to its first position. The movement of the piston to its first position may cause (e.g. by a mechanical coupling) the actuable flap to move (e.g. to close) and thereby prevent fluid flow through the first channel.

The flap may be coupled to the piston by a mechanical coupling and may be moveable by that coupling. For example, a rod may connect the piston to the flap. The flap may be actuable by the piston by any suitable coupling or connection.

The flap may close an inlet or an outlet of the first channel e.g. by covering it. For example, the flap may close an inlet to the first channel from the first fluid volume, or may close an outlet of the first channel into the second fluid volume.

The flow restrictor may comprise a plurality of flaps. For example, the flow restrictor may comprise two flaps and may simultaneously prevent flow into the first channel from the first fluid volume and prevent flow out of a second channel into the second fluid volume. The two flaps may always move in synchronisation, so that the cross-section of flow through the plurality of channels is always uniform along their length.

The first and second fluid volumes may be adjacent each other in a header of the evaporator e.g. the evaporator may be a two-pass evaporator. The evaporator may comprise a partition or separator (e.g. a wall) in the header, thereby separating the first fluid volume from the second fluid volume. The plurality of channels may flow back and fore through the evaporator. The plurality of channels may double back (e.g. u-turn). The evaporator may comprise another second header on an opposed side of the evaporator to the first header, and the plurality of channels may comprise a first bundle (e.g. one pass through the evaporator) for providing flow from the first fluid volume to the second header, and a second bundle (e.g. another pass through the evaporator) for providing fluid flow from the second header to the second fluid volume. Flow through the second bundle may be parallel and opposite flow through the first bundle. The second header may be downstream of the first fluid volume. All fluid flow exiting the first fluid volume may be passed to the second header via the first bundle. The second header may be upstream of the second fluid volume. All fluid flowing flow exiting the second header may be passed to the second fluid volume via the second bundle. All fluid flow in to the second header may be from the first fluid volume and all fluid flow in to the second fluid volume may be from the second header. The second header may therefore fluidly connect the first bundle to the second bundle.

The flow restrictor may be within the header. The flow restrictor may be entirely within the header. The flow restrictor may therefore be part of the evaporator. The flow restrictor may be disposed within the partition (e.g. wall) separating the first and second fluid volumes. The flow restrictor may therefore be within and/or between the first and second fluid volumes. The flow restrictor may be partially within the first fluid volume and partially within the second fluid volume. By locating the flow restrictor in and between the first and second fluid volumes, the flow restrictor may be simply exposed to pressures with the first and second fluid volumes, and may therefore automatically regulate the flow through the evaporator as described herein.

The flow restrictor may be outside the first fluid volume and the second fluid volume. The evaporator may therefore be a single-pass evaporator or a multi-pass evaporator. Each of the first and second fluid volumes may be partitioned into a primary fluid volume and an auxiliary fluid volume. The system may comprise an auxiliary inlet into the auxiliary fluid volume of the first fluid volume, and an auxiliary outlet from the auxiliary fluid volume of the second fluid volume. The flow restrictor may be arranged to permit or prevent flow through the auxiliary inlet and/or the auxiliary outlet to thereby permit or prevent fluid flow through the first channel. The flaps may be disposed within the auxiliary inlet and/or auxiliary outlet.

The system may comprise a first pressure conduit to the flow restrictor and a second pressure conduit to the flow restrictor. The first and second pressure conduits may be arranged to actuate the flow restrictor (e.g. the piston) based on the pressure difference between the primary volume of the first fluid volume and the primary volume of the second fluid volume.

The flow restrictor may be configured to automatically limit a pressure drop between the first fluid volume and second fluid volume e.g. by changing modes in response to changes in the pressure difference. The flow restrictor may therefore automatically regulate fluid velocity through the plurality of channels, and hence may automatically regulate turbulence therein (since turbulence dependent upon fluid velocity). The flow restrictor may therefore ensure sufficient turbulence in the plurality of channels for efficient heat exchange over a wider range of operational parameters than is possible without the flow restrictor. The flow restrictor may therefore be configured to guarantee a required Reynolds number of the heat exchanging fluid flow.

According to a second aspect of the invention there is provided a method of operating a refrigeration system to transition from a first mode of operation to a second mode of operation, the refrigeration system comprising an evaporator comprising a first fluid volume upstream of a second fluid volume, and a plurality of channels fluidly connecting the first fluid volume and the second fluid volume; the method comprising permitting or preventing fluid flow through a first channel of the plurality of channels based on a pressure difference between the first fluid volume and the second fluid volume.

The method may comprise permitting fluid flow through the first channel (e.g. using a flow restrictor) in response to the pressure difference exceeding a predetermined threshold. The method may comprise increasing a total flow cross-section through the evaporator when the pressure difference exceeds the predetermined threshold. The method may comprise preventing a pressure drop across the evaporator exceeding a predetermined amount.

The method may comprise preventing fluid flow through the first channel (e.g. using the flow restrictor) in response to the pressure difference falling below the predetermined threshold. The method may comprise reducing the total flow cross-section through the evaporator when the pressure difference is less than the predetermined threshold.

The method may comprise changing a flow cross-section through the evaporator in response to a change in the pressure difference between the first fluid volume and the second fluid volume. The method may comprise thereby maintaining a fluid velocity in the plurality of channels within a predetermined range e.g. for desirable heat transfer.

The first mode may be a negative brine temperature, lower-flow mode. The second mode may be a positive brine temperature, higher-flow mode. The method may comprise transitioning the evaporator from the positive brine temperature, higher-flow mode to the negative brine temperature, lower-flow mode, and may further comprise transitioning the evaporator from the from the negative brine temperature mode to the positive brine temperature mode.

The method may comprise automatically permitting flow through the first channel in response to the pressure difference exceeding the predetermined threshold; and/or automatically preventing flow through the first channel in response to the pressure difference falling below the predetermined threshold. That is, no additional input beyond the changes in the pressure difference may be needed.

The method may comprise automatically regulating flow through the plurality of channels by closing and/or opening at least the first channel of the plurality of channels e.g. using the flow restrictor. The method may comprise regulating flow by closing and/or opening multiple of the plurality of channels e.g. using the flow restrictor.

The method may comprise regulating fluid velocity within the plurality of channels by increasing and/or decreasing the number of channels through which fluid flows. The method may comprise automatically regulating the fluid velocity within the plurality of channels by increasing and/or decreasing the number of channels through which fluid flows e.g. by opening and/or closing the channels using the flow restrictor.

The method may comprise maintaining turbulence in the plurality of channels within a predetermined range. The method may comprise decreasing the total-flow cross-section by closing the first channel and thereby increasing the fluid velocity through the open channels of the plurality of channels to maintain turbulence. The method may comprise increasing the total flow cross-section by opening the first channel.

The method may comprise limiting a pressure drop across the evaporator by permitting fluid flow through the first channel. The method may comprise automatically limiting the pressure drop. The method may comprise configuring a flow restrictor to automatically limit a pressure drop between the first fluid volume and second fluid volume, by opening the first channel and permitting fluid flow therethrough. The method may comprise selecting a biasing mechanism of a flow restrictor accordingly.

The method may comprise preventing or permitting flow through multiple of the plurality of channels. It may comprise always permitting flow through at least one of the plurality of channels.

The method may comprise controlling the pressure drop between the first fluid volume and the second fluid volume, and may comprise thereby controlling the fluid velocity through the channels, and may comprise thereby controlling turbulence in the plurality of fluid channels. The method may therefore comprise controlling turbulence in the plurality of channels to ensure sufficient heat exchange. The method may comprise ensuring heat exchange efficiency does not fall below a predetermined level.

The method may comprise using the refrigeration system as described herein with reference to the first aspect of the invention. The refrigeration system as described herein with reference to the first aspect of the invention may be configured to perform the method as described herein with reference to the second aspect of the invention.

According to another aspect of the invention there is provided a system comprising a heat exchanger comprising a plurality of channels, and a flow restrictor operable to open and close some of the plurality of channels. The heat exchanger may be an evaporator. The heat exchanger form part of a liquid coolant cycle. The system may comprise any of the features described herein with reference to the first aspect of the invention, and/or may be configured to perform the method as described herein with reference to the second aspect of the invention.

FIGURES

Certain preferred embodiments of the invention will be described below by way of example only and with reference to the drawings in which.

DESCRIPTION

Figure 1:
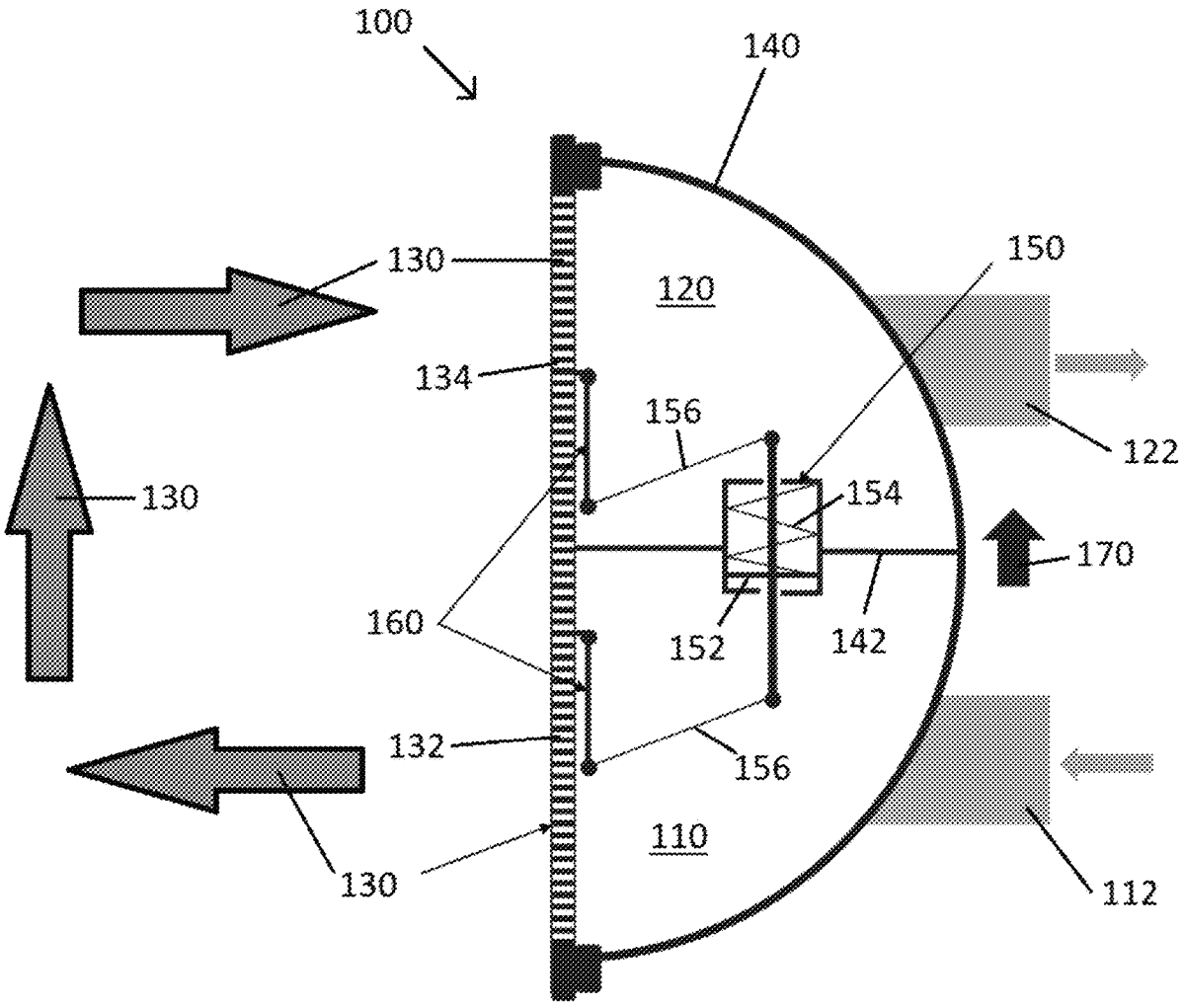
FIG. 1 shows a schematic of a portion of an evaporator with a flow restrictor in a first configuration.

FIG. 1 shows a schematic of a portion of a multi-pass heat exchanger, specifically a two-pass flooded evaporator 100 of a refrigeration system, the flooded evaporator comprising a first fluid volume 110 and a second fluid volume 120. A plurality of channels 130 in the form of a bundle of tubes fluidly connect the first fluid volume 110 to the second fluid volume 120 so that all fluid flow from the first fluid volume 110 to the second fluid volume 120 is via the plurality of channels 130. The arrangement of the channels 130 is only shown schematically by the arrows on the left of FIG. 1.

The evaporator 100 also comprises a header 140 (or water box) within which the first fluid volume 110 and the second fluid volume 120 are defined. The header 140 may be any suitable shape. A partition or wall 142 within the header 140 separates the first fluid volume 110 from the second fluid volume 120. An evaporator inlet 112 is immediately upstream of the first fluid volume 110 and provides fluid flow thereto in use, and an evaporator outlet 122 is immediately downstream of the second fluid volume 120 and receive fluid flow therefrom in use. Therefore, in use, fluid flows from the evaporator inlet 112 to the evaporator outlet 122, via the first fluid volume 110, the plurality of channels 130, and then the second fluid volume 120.

In FIG. 1, inlets 132 of the plurality of channels 130 are shown, which inlets 132 receive fluid flow from the first fluid volume 110. Thus, fluid enters the plurality of channels 130 via the inlets 132 adjacent the first fluid volume 110. Also shown are outlets 134 of the plurality of channels 130, which provide flow to the second fluid volume 120. The inlets 132 and outlets 134 may be defined by a tubesheet or the like. The inlet 132 may therefore be inlets 132 of a first bundle of tubes of the plurality of channels 130 (e.g. flowing right to left in the figure), and the outlets 134 may be outlets 134 of a second bundle of tubes of the plurality of channels 130 (e.g. flowing left to right in the figure). Each bundle of tubes may be one pass of the evaporator.

Although the plurality of channels 130 are shown schematically, the plurality of channels 130 may have any suitable geometry between the inlets 132 and outlets 134. Further, although it is not shown, the flooded evaporator 100 may comprise a second header on the opposite side of the evaporator 100 to the header 140 (e.g. in place of the vertical arrow leftmost in the figure). The second header may receive fluid flow from the inlets 132 and the corresponding ones of the plurality of channels 130 (e.g. from the first bundle of tubes), and may provide fluid flow to the outlets 134 via the corresponding channels of the plurality of channels 130 (e.g. the second bundle of tubes). That is, fluid flow between the inlets 132 and outlets 134 may be via the second header.

The plurality of fluid channels 130 are fluidly isolated from each other except at the first fluid volume 110 and the second fluid volume 120 (and at the second header where the second header is provided). That is, fluid may only flow between each of the plurality of channels 130 in the header 140 (and in the second header where it is used). Fluid therefore cannot flow directly between the channels of the plurality of channels 130.

A flow restrictor 150 is located within the wall 142 and is thereby disposed partially in the first fluid volume 110 and partially in the second fluid volume 120. The flow restrictor 150 is therefore subject to a pressure difference 170 between the first fluid volume 110 and the second fluid volume 120 (depending on the pressure drop through the evaporator). The flow restrictor 150 comprises a piston 152 and a spring 154. The piston 152 is moveable between a first position in which the spring 154 is fully extended, and a second position in which the spring 154 is compressed. The spring 154 is therefore arranged to bias the piston 152 to the first position e.g. against a force from the pressure difference 170.

The flow restrictor 150 comprises mechanical couplings or rods 156 which are coupled to opposed ends of the piston 152. Actuable flaps 160 are coupled to respective ends of the rods 156 opposite the piston 152. The actuable flaps 160 are each pivotably coupled to the tubesheet defining the inlets 132 and outlets 134 of the plurality of channels 130. The flaps 160 are arranged to cover some of the inlets 132 and some of the outlets 134. The flaps are therefore arranged to reduce the number of inlets 132 receiving flow from the first fluid volume 110, and to reduce the number of outlets 134 permitting fluid flow into the second fluid volume 120.

FIG. 1 shows the flooded evaporator 100 and flow restrictor 150 arrangement in a first configuration, during negative brine temperature operation of the refrigeration system. In this configuration, a lower fluid flow is needed, but fluid velocity through the evaporator and channels 130 needs to be promoted in order to ensure sufficient turbulence therein for efficient heat transfer.

In FIG. 1, the pressure difference 170 between the first fluid volume 110 and the second fluid volume 120 is less than a predetermined threshold required to move the piston 152 against the biasing action of the spring 154. As such, the actuable flap 160 in the first fluid volume is in a closed position, covering some (but not all) of the inlets 132 of the plurality of channels 130 and thereby preventing fluid flow through the corresponding ones of the channels 130. The actuable flap 160 in the second fluid volume 120 is also in a closed position, covering some (but not all) of the outlets 134 of the plurality of channels 130, preventing fluid flow through corresponding ones of the channels 130.

Since the flow restrictor 150 prevents fluid flow through multiple of the plurality of channels 130, and therefore permits fluid flow though only some of the plurality of channels 130, the total flow cross-section through the evaporator 100 is reduced and the fluid velocity of the flow is increased. As such, turbulence is maintained at a sufficient level to ensure efficient heat transfer.

Figure 2:
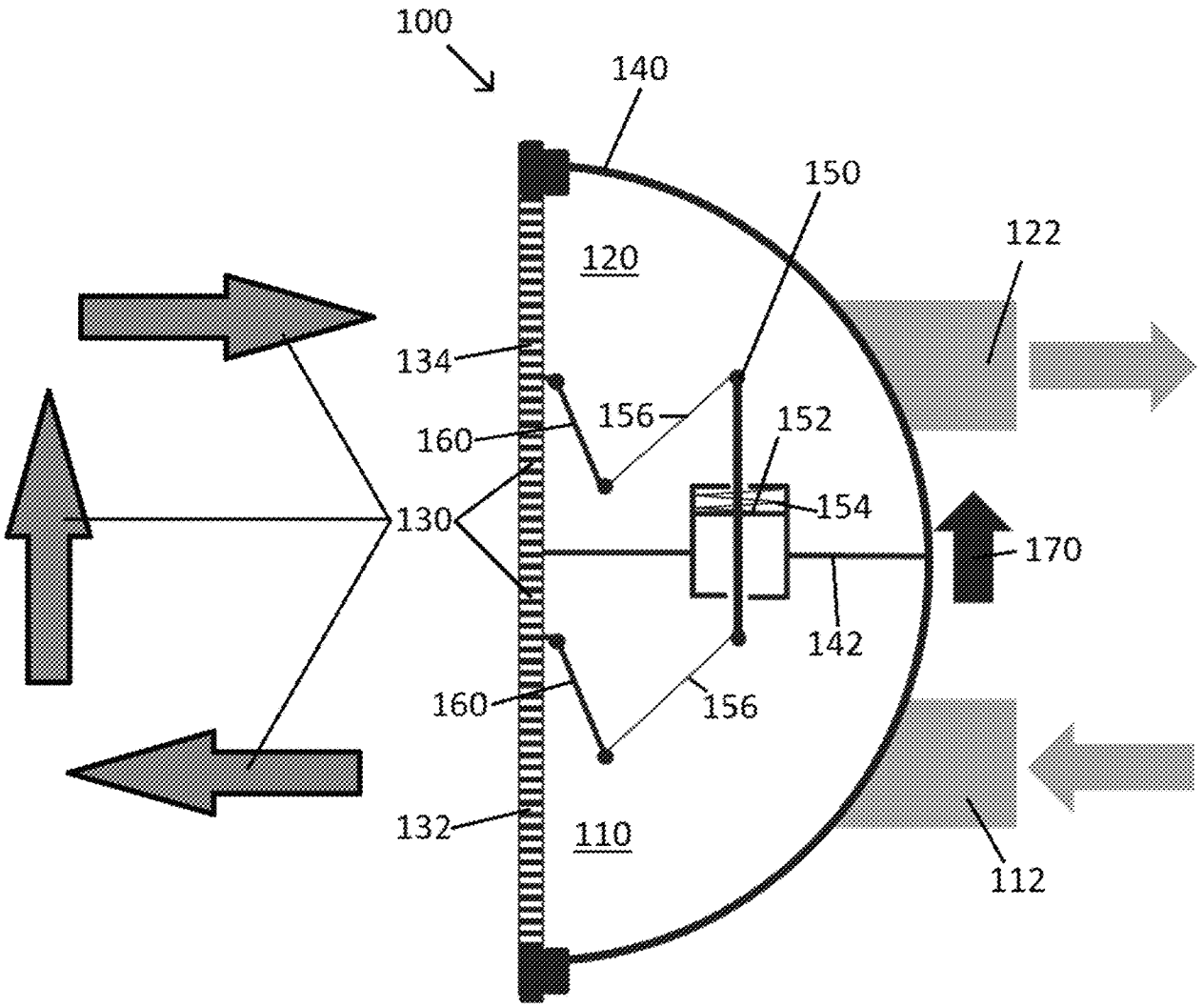
FIG. 2 shows the portion of the evaporator of FIG. 1 with the flow restrictor in a second configuration.

FIG. 2 shows the flooded evaporator 100 of FIG. 1 in a second configuration, during positive brine temperature operation of the refrigeration system. During such conditions, a higher flow rate is needed but an increase in the pressure drop across the evaporator 100 is not desirable.

In FIG. 2, the pressure difference 170 between the first fluid volume 110 and the second fluid volume 120 has increased beyond the predetermined threshold, and the piston 152 has therefore been moved by the pressure difference 170 against the biasing action of the spring 154 into its second position. The rods 156 have therefore also moved the actuable flaps 160 to their open positions, so that the inlets 132 and outlets 134 of the plurality of channels 130 that were covered, are no longer covered. As such, fluid flow is permitted through the corresponding channels 130 by movement of the flaps 160.

Since the flow restrictor 150 permits fluid flow through all of the plurality of channels 130, the total flow cross-section through the evaporator is increased. Therefore, a higher flow rate through the evaporator is achieved, and the pressure-drop may be controlled.

The flooded evaporator 100 and flow restrictor 150 therefore enable the refrigeration system to operate in two modes, each mode requiring substantially different flow characteristics through the evaporator 100. In a first mode which needs less fluid flow through the evaporator 100 (e.g. a negative temperature brine mode), the flow restrictor 150 is arranged to prevent flow through some of the plurality of channels 130 and thereby reduce the total flow cross-section through the evaporator 100. A reduced heat transfer surface (i.e. fewer channels 130 carrying fluid for heat transfer) is acceptable during this mode because less cooling capacity is delivered from the refrigeration cycle at the lower temperature. The reduced cross-section maintains fluid flow velocity at a level sufficiently high to maintain desirable turbulence in the channels 130, and hence maintain efficient heat transfer. In a second mode which needs more fluid flow through the evaporator 100 (e.g. a positive temperature brine mode), the flow restrictor 150 is arranged to permit flow through the plurality of channels (e.g. through all of the plurality of channels 130) and thereby increase the total flow cross-section through the evaporator 150. In such a mode, an increased heat transfer surface (i.e. more channels 130 carrying fluid for heat transfer) is needed due to the higher cooling capacity delivered by the refrigeration cycle. The increased cross-section allows increased total fluid flow without making a pressure drop across the evaporator too large.

Moreover, the flow restrictor 150 automatically transitions between configurations in response to the pressure difference 170 between the first fluid volume 110 and second fluid volume 120. It is therefore operable to automatically limit the pressure drop between the first fluid volume 110 and the second fluid volume 120, thereby ensuring efficient operation of the refrigeration system. The spring 154 may be configured (e.g. during assembly) to provide the mode transition at the desired time, e.g. depending upon parameters of the system such as fluid physical properties, heating/cooling requirements, and so on.

Figure 3:
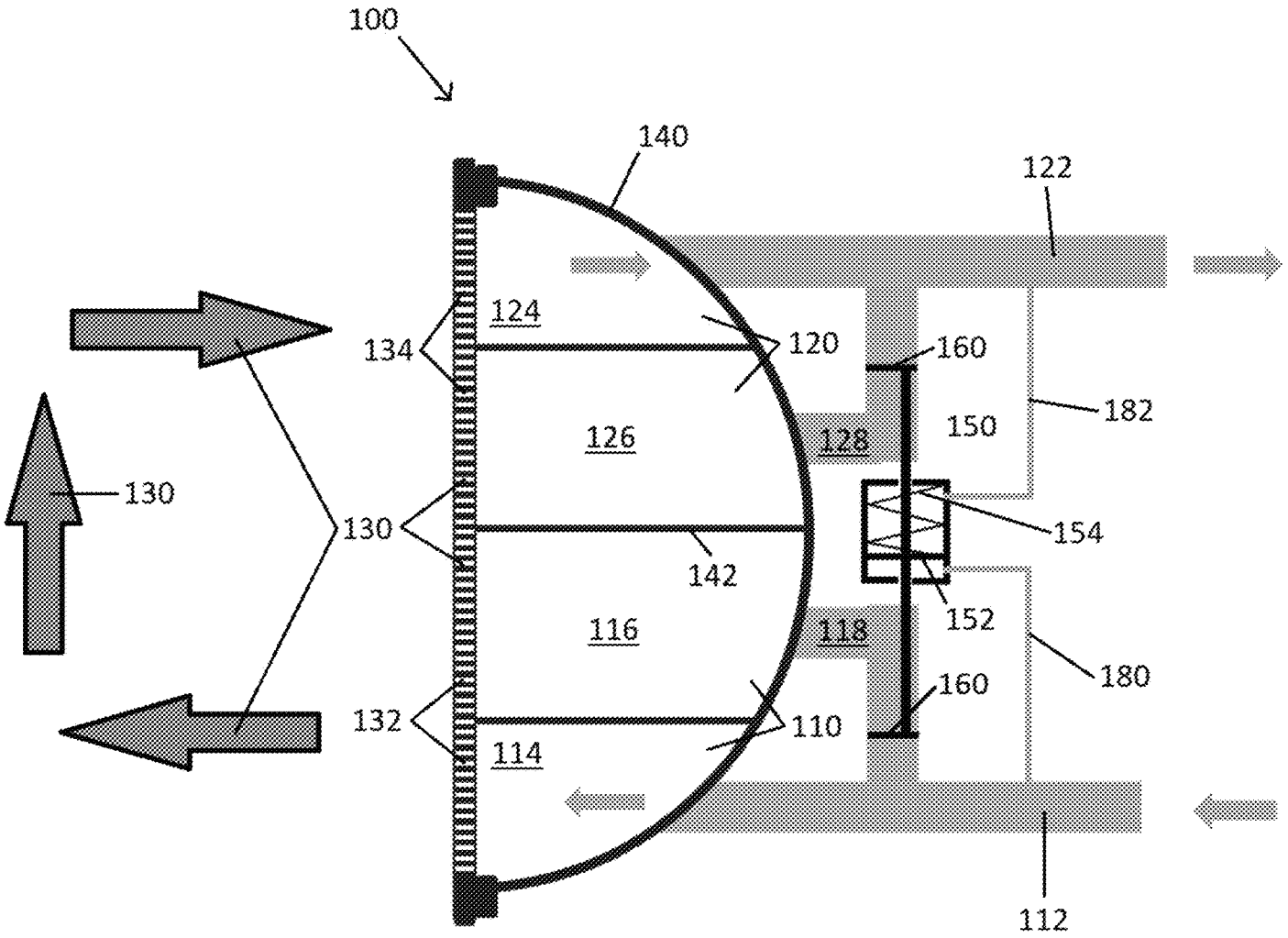
FIG. 3 shows a schematic of a portion of an evaporator with a flow restrictor in a first configuration.

FIG. 3 shows an alternative flooded evaporator 100 and flow restrictor 150. Therein, the first fluid volume 110 is divided into a primary fluid volume 114 and an auxiliary fluid volume 116. The primary fluid volume 114 receives fluid flow from the evaporator inlet 112 regardless of the configuration of the flow restrictor 150 (e.g. always receives flow from the evaporator inlet 112 during use. The auxiliary fluid volume 116 receives fluid flow from the evaporator inlet 112 only if the flow restrictor 150 permits such flow. The inlets 132 of the plurality of channels 130 are divided between the primary fluid volume 114 and the auxiliary fluid volume 116, and therefore only receive fluid from either one or the other.

The second fluid volume 120 also comprises a primary fluid volume 124 and an auxiliary fluid volume 126. The outlets 134 of the plurality of channels 130 are divided between the primary fluid volume 124 and the secondary fluid volume 126. The primary fluid volumes 114, 124 are therefore fluidly isolated from their respective auxiliary fluid volumes 116, 126 within the header 140.

The flow restrictor 150 also comprises a first pressure conduit 180 fluidly connecting one side of the piston 152 to the pressure at the evaporator inlet 112, and a second pressure conduit 182 fluidly connecting the other side of the piston 152 to the pressure at the evaporator outlet 122. The first pressure conduit 180 and second pressure conduit 182 therefore ensure the piston 152 is responsive to the pressure difference 170 between the primary fluid volume 114 of the first fluid volume 110 and the primary fluid volume 124 of the second fluid volume 120.

The flow restrictor 150 comprises actuable flaps 160 operable to open and close an auxiliary inlet 118 and an auxiliary outlet 128, and thereby permit or prevent fluid flow through some of the plurality of channels 130 in communication with the auxiliary fluid volumes 116, 126. The auxiliary inlet 118 provides fluid flow the auxiliary fluid volume 116, and the auxiliary outlet 128 receives fluid flow from the auxiliary fluid volume 126.

Thus, similarly to the evaporator 100 and flow restrictor 150 of FIGS. 1 and 2, the evaporator 100 and flow restrictor 150 of FIG. 3 enables operation of the refrigeration system is two distinct modes. In the first mode, shown in FIG. 3, the pressure 170 between the evaporator inlet 112 and evaporator outlet 122 is below the predetermined threshold and the refrigeration system is in a first mode (e.g. a negative brine temperature mode). Fluid flow through some (but not all) of the plurality of channels 130 is prevented by the actuable flaps 160 being in their closed positions, preventing fluid flow through the auxiliary inlet 118 and auxiliary outlet 128, and hence preventing flow through the associated channels of the plurality of channels 130.

Figure 4:
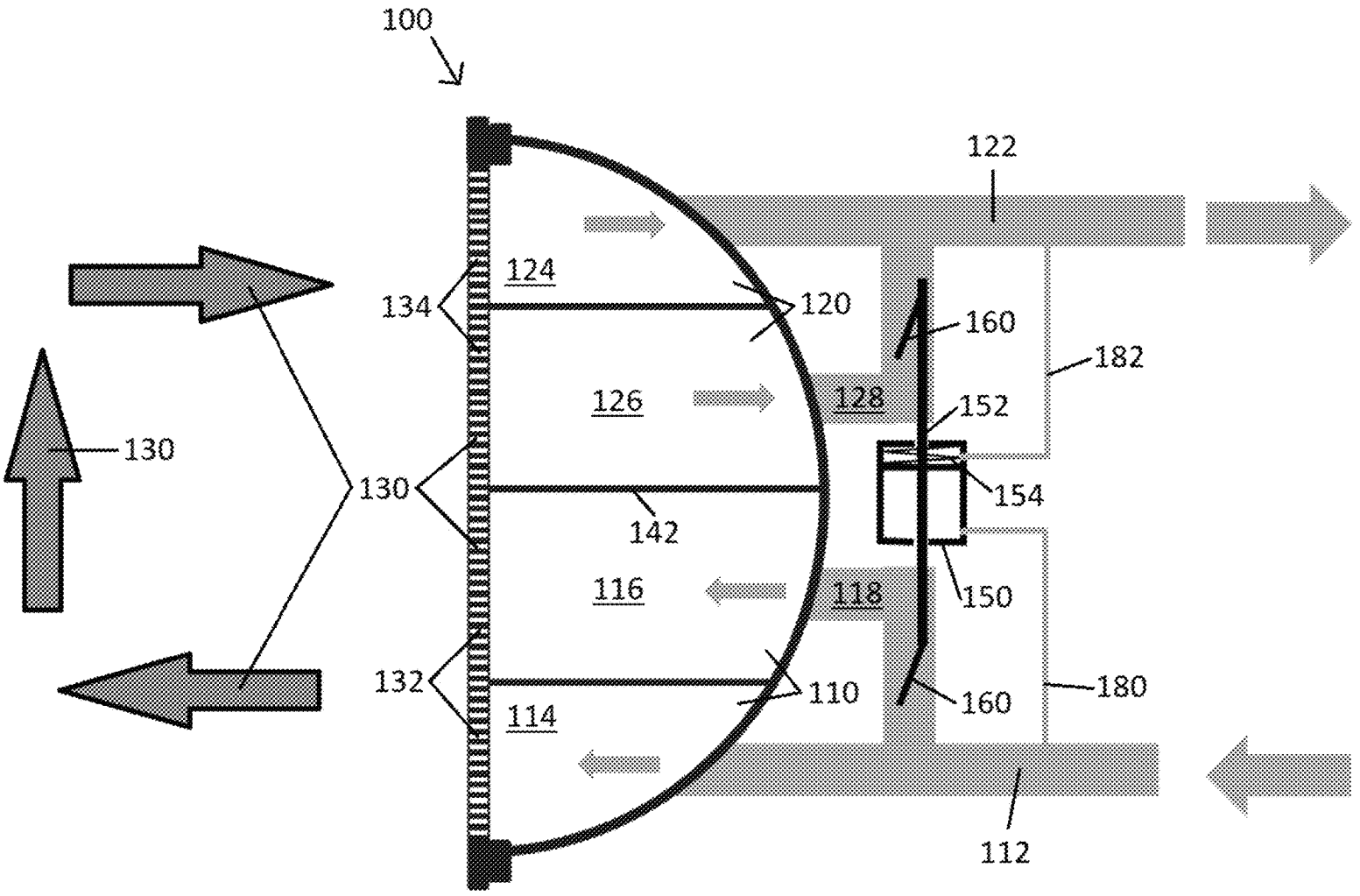
FIG. 4 shows the portion of the evaporator of FIG. 3 with the flow restrictor in a second configuration.

FIG. 4 shows the evaporator 100 and flow restrictor 150 of FIG. 3 when the refrigeration system is operating in its second mode (e.g. a positive brine temperature mode). In the depicted case, the pressure difference 170 exceeds the predetermined threshold and the actuable flaps 160 are moved to their open positions, permitting fluid flow through the auxiliary inlet 118 and the auxiliary outlet 128, thereby permitting fluid flow through corresponding channels of the plurality of channels 130.

The proportion of channels of the plurality of channels 130 that are controlled by the flow restrictor 150 can be selected as required. Moreover, the strength of the spring 154 can be selected as required, so that the evaporator changes modes under predetermined conditions. Further, since the flow restrictor 150 is outside the header 140, a manual override (not shown) may be provided for a user to manually control the actuable flaps 160 e.g. manually open them after increasing a pump speed of the system, or manually close them after decreasing the pump speed of the system.

Although the evaporator in FIGS. 3 and 4 is a two-pass evaporator, since the flow restrictor 150 is outside the header 140, it could also be used with a single-pass heat exchanger, or any multi-pass heat exchanger.

The flow restrictor 150 may be arranged so that it controls the same number of inlets 132 as outlet 134, thereby helping uniform fluid velocity in the plurality of channels 130 with fluid flow therein. Alternatively, the number of channels 130 in each bundle of tubes controlled by the flow restrictor 150 may be selected based on a temperature difference between each pass of the evaporator 100.

Although FIGS. 3 and 4 show a mechanical flow restrictor 150, an electronic flow restrictor may be used instead. For example, the pressure conduits 180 and 182 could be replaced by pressure transducers, and the actuable flaps 160 could be replaced by solenoid valves, or motorised valves.

An electronic controller could then be provided to open and close the valves in response to the pressures measured by the pressure transducers. The pressure transducers may also be overridden by the electronic controller if required.

What is claimed is:

1. A refrigeration system comprising an evaporator, the evaporator comprising:

a first fluid volume upstream of a second fluid volume, and a plurality of channels fluidly connecting the first fluid volume and the second fluid volume;

the refrigeration system further comprising a flow restrictor arranged to prevent fluid flow through at least a first channel of the plurality of channels in response to a pressure difference between the first fluid volume and the second fluid volume being less than a predetermined threshold, and to permit fluid flow through the first channel in response to the pressure difference being greater than the predetermined threshold;

wherein the refrigeration system is arranged so that:

the first and second fluid volumes receive a coolant fluid;

a refrigerant is outside the first and second fluid volumes, and outside the plurality of channels; and the coolant fluid exchanges heat with the refrigerant to thereby heat and evaporate the refrigerant and cool the coolant fluid.

2. The refrigeration system as claimed in claim 1, wherein the flow restrictor is mechanical.

3. The refrigeration system as claimed in claim 1, wherein the flow restrictor comprises a piston moveable between a first position and a second position, and a biasing mechanism arranged to urge the piston to the first position.

4. The refrigeration system as claimed in claim 1, wherein the flow restrictor comprises an actuable flap arranged to permit or prevent fluid flow through the first channel.

5. The refrigeration system as claimed in claim 1, wherein the first and second fluid volumes are adjacent each other in a header of the evaporator.

6. The refrigeration system as claimed in claim 5, wherein the flow restrictor is within the header.

7. The refrigeration system of claim 1, wherein the flow restrictor is outside the first fluid volume and the second fluid volume.

8. The refrigeration system as claimed in claim 1, wherein the flow restrictor is configured to automatically limit a pressure drop between the first fluid volume and second fluid volume.

9. A method of operating a refrigeration system to transition from a first mode of operation to a second mode of operation, the refrigeration system comprising an evaporator comprising a first fluid volume upstream of a second fluid volume, and a plurality of channels fluidly connecting the first fluid volume and the second fluid volume; the method comprising permitting or preventing fluid flow through a first channel of the plurality of channels based on a pressure difference between the first fluid volume and the second fluid volume;

wherein the refrigeration system is arranged so that:

the first and second fluid volumes receive a coolant fluid;

a refrigerant is outside the first and second fluid volumes, and outside the plurality of channels; and the coolant fluid exchanges heat with the refrigerant to thereby heat and evaporate the refrigerant and cool the coolant fluid.

10. The method as claimed in claim 9, comprising permitting fluid flow through the first channel in response to the pressure difference exceeding a predetermined threshold.

11. The method as claimed in claim 9, comprising preventing fluid flow through the first channel in response to the pressure difference falling below the predetermined threshold.

12. The method as claimed in claim 9, comprising regulating fluid velocity within the plurality of channels by increasing and/or decreasing the number of channels through which fluid flows.

13. The method as claimed in claim 9, comprising maintaining turbulence in the plurality of channels within a predetermined range.

14. The method as claimed in claim 9, comprising limiting a pressure drop across the evaporator by permitting fluid flow through the first channel.

* * * * *